US009216875B1

(12) United States Patent
Iwaki

(10) Patent No.: US 9,216,875 B1
(45) Date of Patent: Dec. 22, 2015

(54) PRINTER APPARATUS

(71) Applicant: TOSHIBA TEC KABUSHIKI KAISHA, Shinagawa-ku, Tokyo (JP)

(72) Inventor: Takahisa Iwaki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/529,305

(22) Filed: Oct. 31, 2014

(51) Int. Cl.
*G06F 7/00* (2006.01)
*B65H 37/00* (2006.01)

(52) U.S. Cl.
CPC ..... *B65H 37/00* (2013.01)

(58) Field of Classification Search
USPC ..... 700/226
See application file for complete search history.

(56) References Cited

U.S. PATENT DOCUMENTS

| | | | | |
|---|---|---|---|---|
| 4,972,958 | A * | 11/1990 | Ito et al. | 209/534 |
| 6,588,569 | B1 * | 7/2003 | Jenrick et al. | 194/206 |
| 7,357,303 | B2 | 4/2008 | Taniyama et al. | |
| 2013/0186729 | A1 * | 7/2013 | Miksic et al. | 194/206 |
| 2013/0248320 | A1 * | 9/2013 | Tomizawa | 194/206 |

FOREIGN PATENT DOCUMENTS

JP 03-026424 2/1991

* cited by examiner

*Primary Examiner* — Kyle Logan
(74) *Attorney, Agent, or Firm* — Amin, Turocy & Watson, LLP

(57) ABSTRACT

A printer apparatus comprises an insertion and discharging port; a first conveyance path configured to convey a first printing medium inserted from the insertion and discharging port towards a given printing position in a downstream direction, and convey the first printing medium in a direction opposite to the downstream direction and discharge the first printing medium from the insertion and discharging port; a first printing section configured to carry out printing on the first printing medium conveyed to the printing position; a second printing section configured, viewed from the insertion and discharging port, at the downstream side of the first printing section and configured to have a printing method different from that of the first printing section; a second conveyance path configured to merge with the first conveyance path at the downstream side of the first printing section of the first conveyance path so as to discharge a second printing medium printed by the second printing section through the first conveyance path from the insertion and discharging port; a collection section configured at the downstream side of a mergence section of the first conveyance path and the second conveyance path; a collected medium determination section configured to determine the medium category of the first printing medium and the second printing medium collected in the collection section and grant a collected medium value for each medium; a total collection calculation section configured to add up the collected medium values of the media collected in the collection section; and a notification section configured to notify an instruction of removing the collected media from the collection section depending on a result of a comparison of an collection allowable value calculated according to the allowed collection quantity of the collection section and the value of the total collection calculation section.

4 Claims, 8 Drawing Sheets

FIG.6

| MEDIUM CATEGORY | CONDITION | COUNTER VALUE |
|---|---|---|
| BOOKLET | — | 10 |
| ROLL PAPER | LENGTH IS SHORTER THAN 70mm | 1 |
| | LENGTH IS LONGER THAN 70mm BUT SHORTER THAN 140mm | 2 |
| | LENGTH IS LONGER THAN 140mm | 3 |

| MEDIUM CATEGORY | CONDITION (PAPER THICKNESS) | CONDITION (LENGTH) | COUNTER VALUE |
|---|---|---|---|
| BOOKLET | — | — | 10 |
| ROLL PAPER | t1 | LENGTH IS SHORTER THAN 70mm | 1 |
| | | LENGTH IS LONGER THAN 70mm BUT SHORTER THAN 140mm | 2 |
| | | LENGTH IS LONGER THAN 140mm | 3 |
| | t2 | LENGTH IS SHORTER THAN 70mm | 2 |
| | | LENGTH IS LONGER THAN 70mm BUT SHORTER THAN 140mm | 4 |
| | | LENGTH IS LONGER THAN 140mm | 6 |

PRINTER APPARATUS

FIELD

Embodiments described herein relate to a printer apparatus which carries out printing on paper or a booklet, and collects the printed paper or the booklet if the paper or the booklet is not taken away by a user.

BACKGROUND

Currently, a dot printer is used to print on a booklet such as a passbook used by a financial institution. In addition to the printing on the booklet such as a passbook and the like, a business form such as a statement of account and the like is also issued. The printing on the business form is carried out by a thermal printer, and after printed with specific items, long-sized paper pulled out from paper wound in a roll shape is cut into a sheet having a specific length and then discharged. The dot printer and the thermal printer are arranged separately.

As the printers are arranged separately, it is necessary to arrange the power supply sections and the like separately, which leads to the large size and high cost of the machine. Thus, it is considered that the dot printing mechanism and the thermal printing mechanism share the same conveyance path.

Information which is not supposed to be seen by other persons, such as the deposit balance information and the like, is printed on the passbook or the business form printed by the printers. Thus, in the printers, a collection mechanism is known which collects the passbook or the business form a user forgets to take away to the inside of the main body of the printer after a given time elapses. As the allowed quantity of the collected media storage space of the collection mechanism is determined, the collection mechanism can only store a certain quantity of media. Therefore, it is known that a collection counting processing is carried out when collecting media, and if the count exceeds the count of the pre-determined allowed quantity, the collection operation is temporarily stopped.

When carrying out collection counting, if the sizes and the thicknesses of the collected media (e.g. paper money) are similar, error does not occur so much even if the collection counts of the collected media of different categories are made the same. However, in a case where the sizes and the thicknesses of the collected media are greatly different, if the collection counts of the collected media of different categories are made the same, occurrence of error increases, which leads to a problem that the actual quantity of the collected media exceeds the allowed quantity of the collected media storage space though the collection count of the collected media does not exceed the count of the pre-determined allowed quantity.

BRIEF DESCRIPTION OF THE DRAWINGS

FIG. 6 is a data table illustrating a counter value of each booklet and business form according to the present embodiment;

DETAILED DESCRIPTION

A printer apparatus comprises an insertion and discharging port; a first conveyance path configured to convey a first printing medium inserted from the insertion and discharging port towards a given printing position in a downstream direction, and convey the first printing medium in a direction opposite to the downstream direction and discharge the first printing medium from the insertion and discharging port; a first printing section configured to carry out printing on the first printing medium conveyed to the printing position; a second printing section configured, viewed from the insertion and discharging port, at the downstream side of the first printing section and configured to have a printing method different from that of the first printing section; a second conveyance path configured to merge with the first conveyance path at the downstream side of the first printing section of the first conveyance path so as to discharge a second printing medium printed by the second printing section through the first conveyance path from the insertion and discharging port; a collection section configured at the downstream side of a mergence section of the first conveyance path and the second conveyance path; a collected medium determination section configured to determine the medium category of the first printing medium and the second printing medium collected in the collection section and grant a collected medium value for each medium; a total collection calculation section configured to add up the collected medium values of the media collected in the collection section; and a notification section configured to notify an instruction of removing the collected media from the collection section depending on a result of a comparison of an collection allowable value calculated according to the allowed collection quantity of the collection section and the value of the total collection calculation section.

A First Embodiment

Hereinafter, the printer apparatus according to the first embodiment is described in detail with reference to the accompanying drawings.

Figure 1:
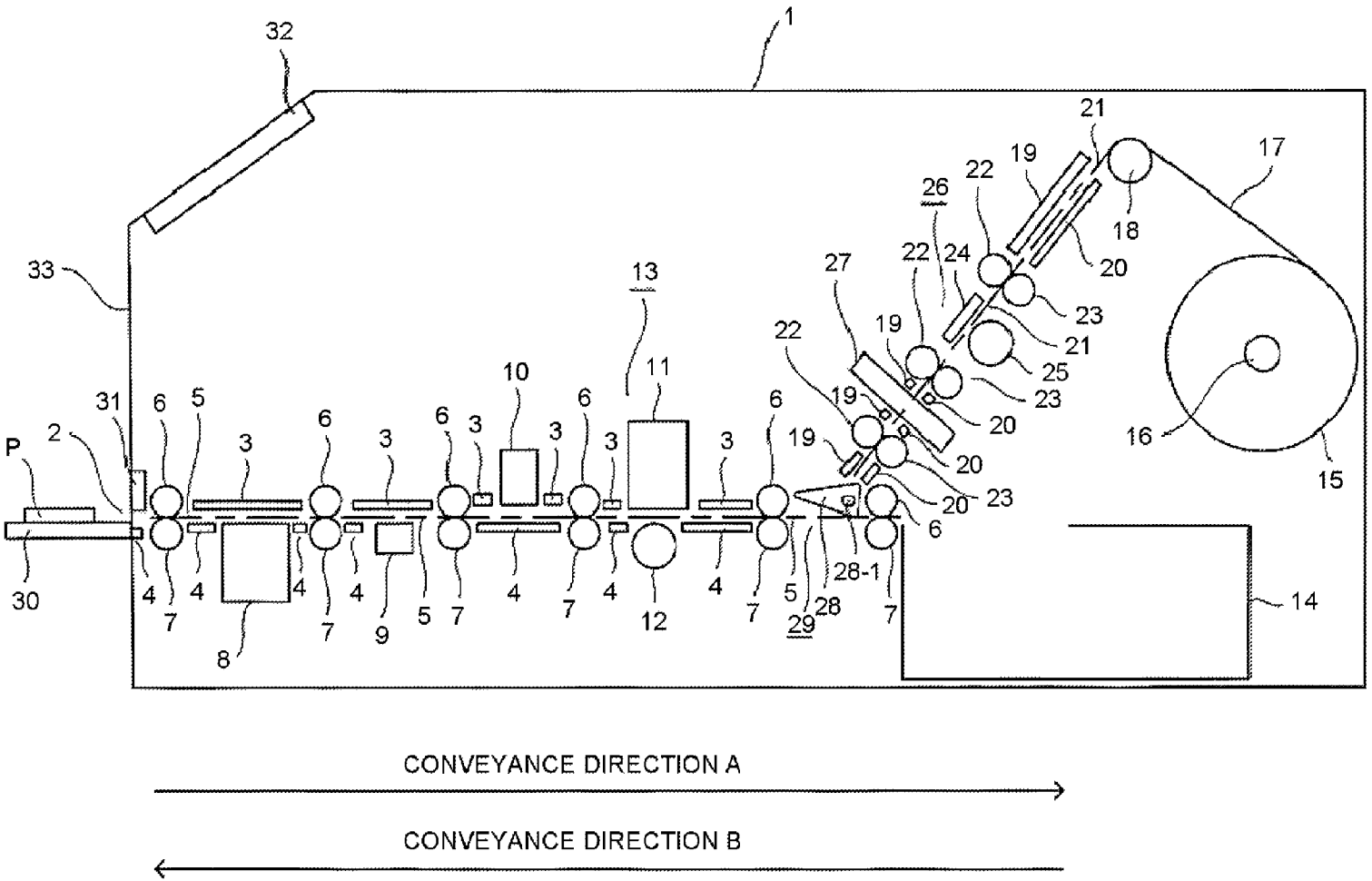
FIG. 1 is a constitution diagram illustrating the main portions of a printer apparatus according to one present embodiment.

FIG. 1 is a constitution diagram illustrating the main portions of the printer apparatus according to the first embodiment.

A composite printer apparatus 1 includes a plurality of different printing mechanisms. In addition, in the following description of the present embodiment, the left side in FIG. 1 is referred to as a front side of the composite printer apparatus 1, and the right side in FIG. 1 is referred to as a rear side of the composite printer apparatus 1.

At the front side of the composite printer apparatus 1, an insertion and discharging port 2 is arranged for inserting a booklet P such as a passbook, or discharging the printed booklet P or later-described roll paper 15 serving as a business form which is cut after the printing is completed to the outside of the composite printer apparatus 1. In the present embodiment, the roll shape paper is referred to as the roll paper 15 and the business form obtained by cutting the roll paper 15 after required items are printed on the roll paper 15 is referred to as a business form C.

A collection box 14 is arranged at the rear side of the composite printer apparatus 1 to collect and store the booklet P and the business form C a user forgets to take.

A first conveyance upper guide 3 and a first conveyance lower guide 4 are arranged to extend in the space from the insertion and discharging port 2 to the collection box 14, and the space between the first conveyance upper guide 3 and the first conveyance lower guide 4 is regarded as a first paper conveyance path 5 for conveying the booklet P and the roll paper 15. In the description of the present embodiment, the direction of the conveyance of the booklet P or the business form C from the insertion and discharging port 2 towards the collection box 14 is referred to as a conveyance direction A, and the left side in FIG. 1 (that is, the front side) is referred to as an upstream side and the right side is referred to as a downstream side unless otherwise noted.

At the downstream side of the insertion and discharging port 2 in the conveyance direction A, a feed roller 6 which can be rotated by a motor (not shown) is arranged opposite to an idle roller 7 across the first paper conveyance path 5. The feed roller 6 and the idle roller 7 are in pairs, so as to clamp and convey the booklet P and the business form C. A plurality of pairs of feed roller 6 and idle roller 7 are arranged along the first paper conveyance path 5.

Further, an alignment section 8 is arranged at the downstream side of the insertion and discharging port 2 in the conveyance direction A. The alignment section 8 consisting of a paper position detection sensor (not shown), a shutter, a paper pinch mechanism, an alignment end wall and the like corrects the skew, misalignment and the like of the booklet P inserted from the insertion and discharging port 2 and moves the booklet P to a preset position and attitude.

A MS (MAGNETIC STRIPE) reading/writing section 9 is arranged at the downstream side of the alignment section 8 in the conveyance direction A. The MS reading/writing section 9 carries out information reading and writing processing with a magnetic stripe section (not shown) arranged at the back side of the booklet P.

A PLF (PAGE LINE FINDER) section 10 is arranged at the downstream side of the MS reading/writing section 9 in the conveyance direction A. The PLF section 10 confirms the current opened page of the booklet P.

At the downstream side of the PLF section 10 in the conveyance direction A, a dot head 11 is arranged opposite to a platen 12 across the first paper conveyance path 5. The dot head 11 and the platen 12 constitute a first printing section 13 which carries out printing on the booklet P.

The collection box 14 is arranged at the downstream side of the first printing section 13 in the conveyance direction A.

At the rear side of the composite printer apparatus 1, is loaded the roll paper 15 serving as paper wound around a winding shaft 16 which is supported in a rotatable manner for a frame (not shown).

The roll paper 15 includes a thermo sensitive layer which generates color if heated only on a printing surface A17 serving as one surface thereof.

Further, an idle roller 18 is arranged in the composite printer apparatus 1 to apply a given tension to the roll paper 15.

A second conveyance upper guide 19 and a second conveyance lower guide 20 are arranged to extend from the idle roller 18 towards the front side of the composite printer apparatus 1, and a space between the second conveyance upper guide 19 and the second conveyance lower guide 20 is regarded as a second paper conveyance path 21 for conveying the roll paper 15. The second paper conveyance path 21 merges with the first paper conveyance path 5 at the downstream side of the first printing section 13 in the conveyance direction A. In the description of the present embodiment, the mergence position of the first paper conveyance path 5 and the second paper conveyance path 21 is referred to as a mergence section 29, and the direction of the conveyance of the roll paper 15 or the business form C from the idle roller 18 via the mergence section 29 towards the insertion and discharging port 2 is referred to as a conveyance direction B.

At the downstream side of the idle roller 18 in the conveyance direction B, a feed roller 22 which can be rotated by a motor (not shown) is arranged opposite to an idle roller 23 across the second paper conveyance path 21. The feed roller 22 and the idle roller 23 are in pairs, so as to clamp and convey the roll paper 15. A plurality of pairs of feed roller 22 and idle roller 23 are arranged along the second paper conveyance path 21.

At the downstream side of the idle roller 18 in the conveyance direction B, a thermal print head 24 is arranged opposite to a platen roller 25 which can be rotated by a motor (not shown) across the second paper conveyance path 21. The thermal print head 24 and the platen roller 25 constitute a second printing section 26 which carries out printing on the printing surface A17 of the roll paper 15.

A cutter 27 is arranged at the downstream side of the second printing section 26 in the conveyance direction B. The cutter 27 includes a fixed blade and a movable blade neither of which is shown, and cuts the roll paper 15 inserted in a slit (not shown) arranged in the cutter 27 by sliding and moving the movable blade towards the fixed blade under the driving of a cutter motor (not shown). The cutter 27, which is not limited to a slide type cutter sliding the movable blade towards the fixed blade described herein, may also be a rotary type cutter cutting paper by rotating the movable blade towards the fixed blade.

The first paper conveyance path 5 and the second paper conveyance path 21 merges with each other at the downstream side of the cutter 27 in the conveyance direction B. A flapper 28 is arranged in the mergence section 29 serving as the mergence position. The flapper 28 can be rotated around a flapper rotation shaft 28-1; if the flapper 28 is rotated anticlockwise, the second paper conveyance path 21 is communicated with the first paper conveyance path 5, and if the flapper 28 is rotated clockwise, the paper can be conveyed only on the first paper conveyance path 5 from the insertion and discharging port 2 to the collection box 14.

Further, at the front side of the composite printer apparatus 1 nearby the insertion and discharging port 2, an insertion and discharging table 30 is arranged for temporarily placing the booklet P or the business form C when inserting the booklet P into the composite printer apparatus 1 or when discharging the booklet P or the business form C towards the user. A collection sensor 31 is arranged at the insertion and discharging port 2 to detect whether or not the booklet P or the business form C is taken by the user. Further, a display section 32 is arranged at the upper portion of the composite printer apparatus 1 to display various states of the composite printer apparatus 1, including an error such as a paper jam, paper out and the like.

Figure 2:
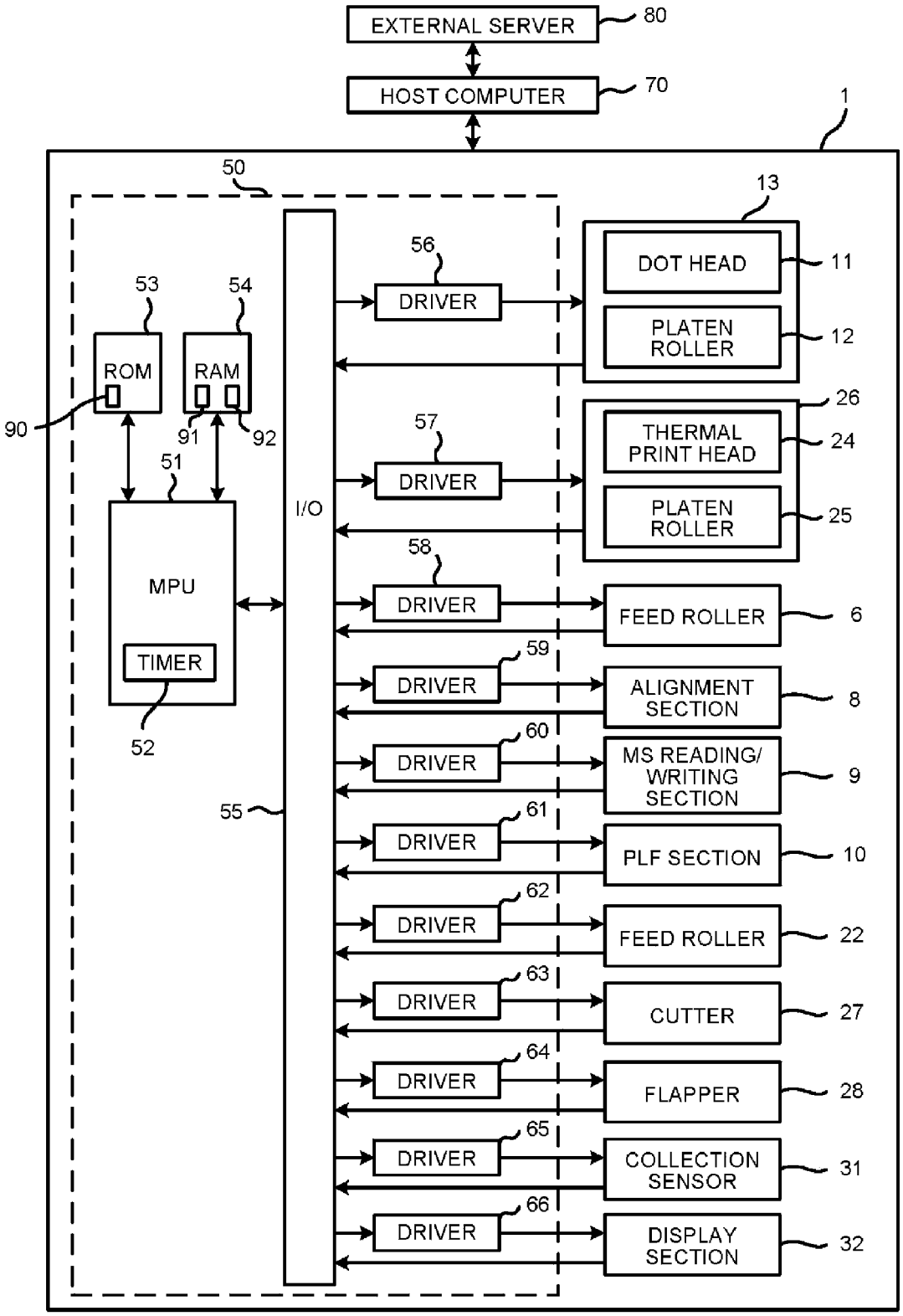
FIG. 2 is a control block diagram of the printer apparatus according to the present embodiment.
Figure 3:
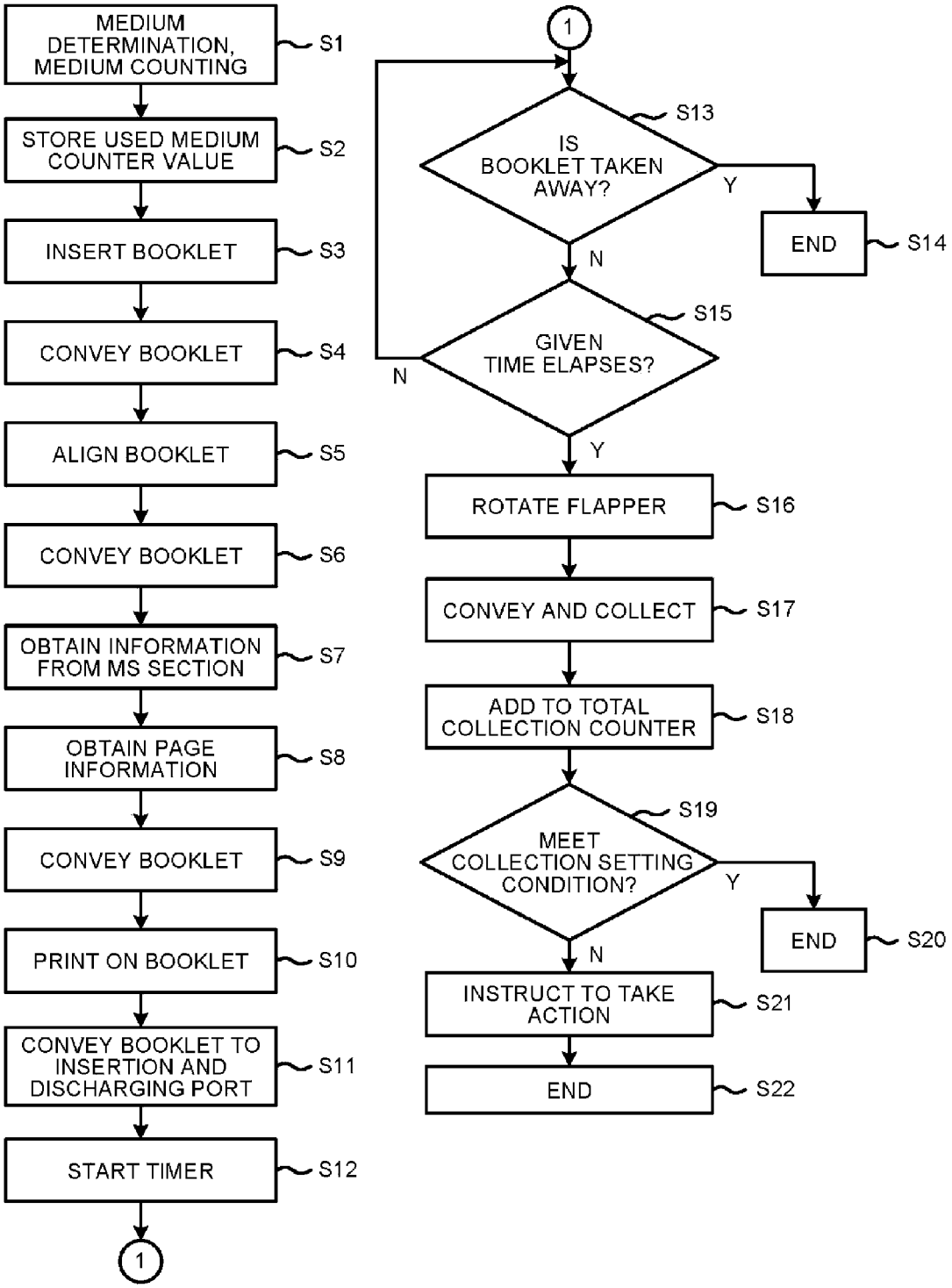
FIG. 3 is a flowchart illustrating a medium count method in a used medium collection when using a booklet according to the present embodiment.

FIG. 2 is a block diagram illustrating the constitution of a control circuit of the composite printer apparatus 1 according to the present embodiment. A control section 50 carries out controls on paper conveyance, printing, paper cutting, paper discharging, paper collection, collection amount detection and condition display of the composite printer apparatus.

The control section 50 is constituted by, for example, a micro-computer which carries out connection with a host computer 70 and the execution of various controls. The host computer 70 is connected with an external server 80 of, for example, a financial institution managing the saving deposit information and the like.

A micro processing unit (MPU) 51 of the control section carries out, according to programs, various controls such as paper conveyance control, printing control, paper cutting control, paper discharging control and paper collection control and execution.

The MPU 51 comprises a timer 52 serving as a unit for carrying out time setting and time control.

A ROM 53 and a RAM 54 are arranged in the control section 50 as primary storage units for storing control programs executed by the MPU 51 and data generated during a control process or an operation process.

The ROM 53 is a read-only memory in which control programs and tables and the like are stored, and the RAM 54 is a random access memory for storing the data generated during an operation process.

A collected medium determination section 90 is arranged in the ROM 53 to determine, when counting the business forms C or the booklets P collected in the collection box which will be described later, the degree of the difference with a specified medium, and determine whether or not the quantity of the business forms C or the booklets P collected in the collection box 14 is within the allowed quantity. Further, a used medium counter 91 (described later) for temporarily holding the count number of the current media and a total collection counter 92 for holding the addition value of the used medium counter from an empty state to the current state of the collection box 14 are arranged in the RAM 54.

An input/output unit (I/O) 55 is arranged in the control section 50 to acquire various input data from the host computer 70 and export a control output of the control section 50 to the host computer 70. The I/O 55 is connected with the MPU 51, the ROM 53 and the RAM 54 via a bus line.

The I/O 55 is connected with a first, a second, a third, a fourth, a fifth, a sixth, a seventh, an eighth, a ninth, a tenth and an eleventh drivers 56, 57, 58, 59, 60, 61, 62, 63, 64, 65 and 66 serving as units for exporting a control output.

The first driver 56 supplies a required drive output for the first printing section 13. The second driver 57 supplies a required drive output for the second printing section 26. The third driver 58 supplies a drive output for the feed roller 6. The fourth driver 59 supplies a drive output for the alignment section 8. The fifth driver 60 supplies a drive output for the MS reading/writing section 9. The sixth driver 61 supplies a drive output for the PLF section 10. The seventh driver 62 supplies a drive output for the feed roller 22. The eighth driver 63 supplies a drive signal for the cutter 27. The ninth driver 64 supplies a drive signal for the flapper 28. The tenth driver 65 supplies a drive output for the collection sensor 31. The eleventh driver 66 supplies a drive signal for the display section 32.

The operations of the composite printer apparatus 1 are described below with reference to FIG. 1 and FIG. 3-FIG. 6. The composite printer apparatus 1 is, for example, incorporated in an automatic teller machine and used. The operations of the composite printer apparatus 1 is described by taking bookkeeping as an example.

The user presses a button which is used when implementing bookkeeping on a screen (not shown) of the automatic teller machine. If the button for bookkeeping implementation is pressed, the control section 50 calculates the counter value of the media used by the composite printer apparatus 1 this time by reference to a table (shown in FIG. 6) which is stored in the collected medium determination section 90 and which will be described later (ACT S1), and stores the value in the used medium counter 91 (ACT S2). In addition, as it is bookkeeping to the booklet P this time, a value "10" is stored in the used medium counter 91.

It is exemplified that the value of the total collection counter 92 which will be described later is "0" at the current collection start time.

Figure 4:
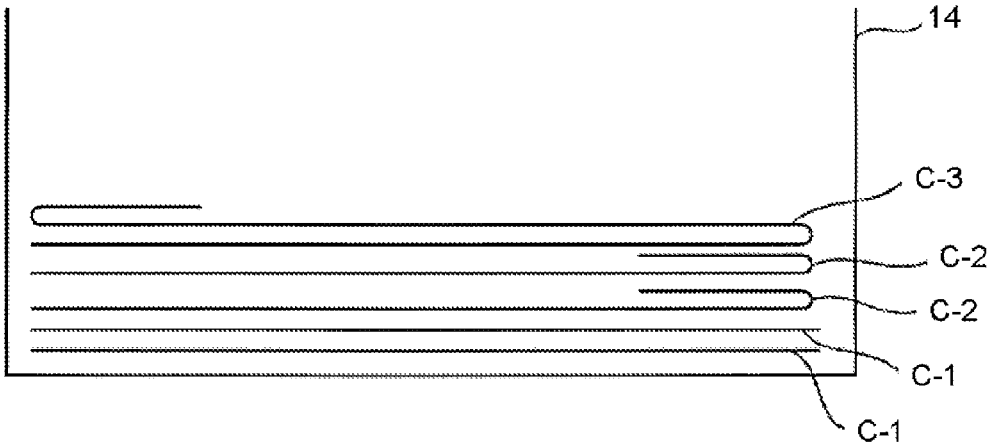
FIG. 4 is an illustration diagram illustrating the effect of the length of a business form on the capacity of a collection box according to the present embodiment.
Figure 5:
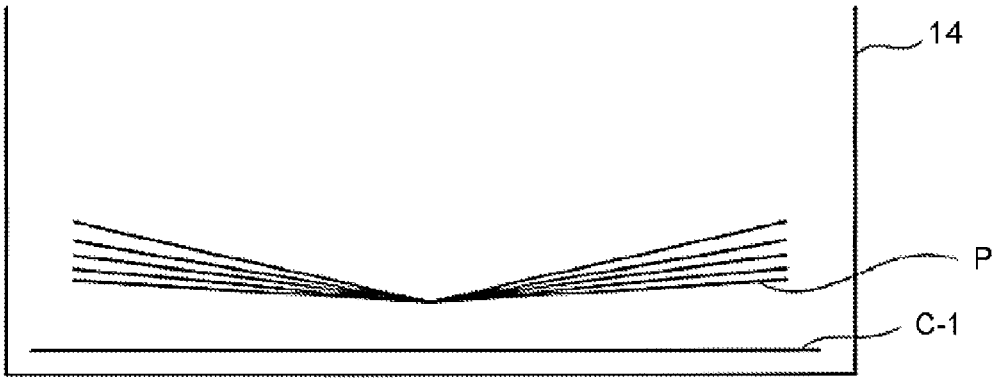
FIG. 5 is an illustration diagram illustrating the effect of the business form and the booklet on the capacity of the collection box according to the present embodiment.

The counter value of the used media is described below with reference to FIG. 4~FIG. 6.

Though the booklet P or the business form C the user forgets to take is collected in the collection box 14, the allowed quantity of the collection in the collection box 14 is determined, and if the collection quantity exceeds the allowed collection quantity, paper jam occurs in the composite printer apparatus 1. To avoid paper jam, it is necessary to know the current degree of the collection quantity with respect to the allowed collection quantity of the collection box 14 and to remove the booklets P or the business forms C from the collection box 14 before the collection quantity exceeds the allowed collection quantity.

If the paper size, paper thickness and the like of the collected media are the same, it is easy to know the current degree of the collection quantity with respect to the allowed collection quantity of the collection box 14 according to the number of collection times. However, the length of the business form C output by the composite printer apparatus 1 is not the same depending on the printing content. For example, as shown in FIG. 4, though each of a business form C-1 having a short length, a business form C-2 having a moderate length and a business form C-3 having a long length is one sheet of paper, the effects thereof to the allowed collection quantity of the collection box 14 are different. If the allowed collection quantity of the collection box 14 is set as the allowable number of the medium having the largest effect, and if the allowed collection quantity is determined according to the number of collection times of the media, it may cause a problem that in a case where a lot of media (for example, the business form C-1) having small effect on the allowed collection quantity are collected, the collection box 14 is determined to be full and incapable of collecting one more medium though the collection box 14 can, in fact, collect more media.

The composite printer apparatus 1 collects not only the business form C, but also the booklet P. As shown in FIG. 5, in a case of collecting the booklet P and in a case of collecting the business form C-1, though the number of collection times is once, the effects thereof to the allowed collection quantity of the collection box 14 are greatly different. Thus, in the present embodiment, as shown by one example in FIG. 6, a table, which takes the effect degree of the medium category and the length of paper when printing on the allowed collection quantity of the collection box 14 into consideration, and sets the used medium counter value serving as a value indicating the degree of the effect on the allowed collection quantity, is arranged in the collected medium determination section 90.

The medium having the smallest effect on the allowed collection quantity within the collected medium categories is set as the specified medium, and the counter value thereof is set to "1". As to the medium categories different from the specified medium, though the number of collection times thereof is once, how much more effect the medium categories different from the specified medium has on the allowed collection quantity with respect to the specified medium is taken into consideration to set the counter values. In the present embodiment, it is determined that the booklet P has ten times more effect on the allowed collection quantity with respect to the specified medium though the number of collection times is once, therefore, a value "10" is stored in the used medium counter 91 as the medium counter value.

Next, the automatic teller machine instructs the user to open the booklet P serving as a passbook and insert the opened booklet P through the insertion and discharging port 2 of the composite printer apparatus 1.

The user opens the booklet P and inserts the opened booklet P through the insertion and discharging port 2 according to the instruction (ACT S3). The composite printer apparatus 1 rotates the feed roller 6 to convey the booklet P to the alignment section 8 through cooperation with the idle roller 7 (ACT S4). The alignment section 8 consisting of a paper position detection sensor (not shown), a shutter, a paper pinch mechanism, an alignment end wall and the like corrects the skew, misalignment and the like of the booklet P conveyed to the alignment section 8 and aligns the booklet P to a preset position and attitude (ACT S5). In addition, as an existing mechanism is used as the alignment mechanism, the detailed description thereof is omitted.

The aligned booklet P is further conveyed to the first printing section 13 through the cooperation of the feed roller 6 and the idle roller 7 (ACT S6). During the conveyance towards the first printing section 13, the MS reading/writing section 9 is arranged on the first conveyance path 5. A MS section (not shown) is arranged at the back side of the booklet P. User information and the like is written in the MS section of the booklet P as magnetic information. The control section 50 obtains, using the MS reading/writing section 9, the user information and the like from the MS section and obtains the transaction information of the user from the external server 80 of a financial institution and the like while conveying the booklet P (ACT S7). In addition, as the exchange of information with the external server 80 of a financial institution and the like is existing content, the detailed description thereof is omitted.

The PLF section 10 is arranged at the downstream side of the MS reading/writing section 9 of the first paper conveyance path 5 in the conveyance direction A. The control section 50 obtains, using the PLF section 10, the page information of the booklet P while conveying the booklet P (ACT S8). As stated above, the control section 50 has already obtained the transaction information of the user. The transaction information includes the information indicating how many pages bookkeeping is carried out on the booklet P. The information is compared with the detected page obtained by the PLF section 10, and if the page different from the page on which printing is supposed to be carried out this time is opened and inserted, the booklet P is conveyed in the conveyance direction B, and the user is instructed to open the correct page of the booklet and insert the booklet again. If a booklet page turning mechanism section (not shown) is arranged in the composite printer apparatus 1, the booklet P may be conveyed to the booklet page turning mechanism section to be turned to the correct page and then be conveyed to this position again.

The booklet P is conveyed to the first printing section 13 via the MS reading/writing section 9 and the PLF section 10 (ACT S9), then printing is carried out on the booklet P by the dot head 11 and the platen roller 12 (ACT S10).

After the printing on the booklet P is completed, the control section 50 rotates the feed roller 6 so as to convey the booklet P in the conveyance direction B and place the booklet P on the insertion and discharging table through the cooperation with the idle roller 7, and stops the conveyance of the booklet P when one part of the booklet P protrudes from a front surface 33 to the outside of the composite printer apparatus 1 (ACT S11).

The transmission-type collection sensor 31 is arranged at the insertion and discharging port 2. The collection sensor 31 is capable of detecting, when the booklet P is stopped at a position where one part of the booklet P protrudes from the front surface 33 to the outside of the composite printer apparatus 1, whether or not the booklet P still exists at the position.

When the conveyance of the booklet P is stopped at a position where one part of the booklet P protrudes from the front surface 33 to the outside of the composite printer apparatus 1, the collection sensor 31 detects that the booklet P still exists at the position. If so, the timer 52 starts the timer to start measuring time (ACT S12), and the sensor signal of the collection sensor 31 is "ON". The setting time measured by the timer 52 will be described later.

Next, the control section 50 confirms, at a given time interval, whether or not the booklet P is taken away by the user (ACT S13). The confirmation on whether or not the booklet P is taken away by the user is carried out based on the detection signal of the collection sensor 31. If the booklet P is still there, the signal of the collection sensor 31 is "ON". On the contrary, if the booklet P is taken away by the user, the detection signal of the collection sensor 31 is switched to "OFF". The confirmation on whether or not the booklet P is taken away by the user can be carried out according to the switching.

If it is confirmed that the booklet P is taken away by the user (YES in ACT S13), the operation of the user is ended (ACT S14).

Whether or not the booklet P is taken away by the user is confirmed at a given time interval (ACT S13), and if it is determined that the booklet P is not taken away by the user (NO in ACT S13), the control section 50 confirms the time of the time measurement started when the conveyance of the booklet P is stopped at a position where one part of the booklet P protrudes from the front surface 33 to the outside of the composite printer apparatus 1, and confirms whether or not the time exceeds a given time (ACT S15). In addition, the given time mentioned herein refers to a preset time (for example, 30 seconds), and if the preset time elapses from the time when the conveyance of the booklet P is stopped at a position where one part of the booklet P protrudes from the front surface 33 to the outside of the composite printer apparatus 1, that is, from the time when the user can take the booklet P away, it can be regarded that the user forgets to take the booklet P away.

If the given time does not elapse (NO in ACT S15), there is a possibility that the user takes away the booklet P, therefore, it is confirmed again whether or not the booklet P is taken away (ACT S13).

It is confirmed whether or not the given time elapses (ACT S15), and if the given time elapses (YES in ACT S15), it is determined that there is a high possibility that the user forgets to take away the booklet P, the control section 50 first rotates the flapper 28 clockwise around the flapper rotation shaft 28-1 (ACT S16). In this way, the first conveyance path 5 is communicated with the collection box 14. Next, the control section 50 rotates the feed roller 6 so as to convey the booklet P in the conveyance direction A and collect the booklet P in the collection box 14 through the cooperation with the idle roller 7 (ACT S17).

As stated above, when the user presses the button which is used when implementing bookkeeping, the control section 50 calculates the counter value of the media used by the composite printer apparatus 1 this time by reference to the table (shown in FIG. 6) stored in the collected medium determination section 90, and stores the value in the used medium counter 91. When the booklet P is collected in the collection box 14, the control section 50 adds "10" (that is, the counter value of the media used this time) stored in the used medium counter 91 to the total collection counter 92 (ACT S18). That is, at the current collection time of the booklet P, the total collection counter 92 becomes "10".

Next, the control section 50 confirms whether or not the value of the total collection counter 92 meets a collection setting condition (ACT S19). The collection setting condition is described below.

As stated above, there is an allowed collection quantity for the collection box 14. The allowed collection quantity of the collection box 14 of the composite printer apparatus 1 is set (collection allowable value) so that the collection box 14 can collect more media until the sum of the counter values of various media shown in FIG. 6 reaches "30". In addition, how a setter operates the composite printer apparatus 1 can be changed by the setter.

For example, in a case of using the composite printer apparatus 1 in a state in which the person in charge of collecting the media in the collection box 14 is not nearby the composite printer apparatus 1 all the time, such an operation may be applied that some actions are taken when the total collection counter 92 exceeds "15", with the time taken by the collector to come for the collection taken into consideration; and in a case where the person in charge of collecting the media in the collection box 14 is nearby the composite printer apparatus 1 all the time, as the collector can come for the collection immediately, such an operation may be applied that some actions are taken when the total collection counter 92 exceeds "20". In this way, the collection setting condition in a case of taking some actions can be set randomly to some extent by the setter. That is, the determination of the collection setting condition refers to the comparison of the collection allowable value calculated according to the allowed collection quantity of the collection section with the current value of the total collection counter 92.

Whether or not the value of the total collection counter 92 meets the collection setting condition is confirmed (ACT S19), and if the value meets the collection setting condition (YES in ACT S19), the operation of the composite printer apparatus 1 is ended (ACT S20). For example, if the collection setting condition mentioned herein is that the preset value of the total collection counter 92 is below "15", as the current total collection counter 92 is "10", it can be determined that there is a margin in the allowed collection quantity of the collection box 14, that is, the collection box 14 can store more media. Thus, at this time, the operation can be ended without taking any action.

Whether or not the value of the total collection counter 92 meets the collection setting condition is confirmed (ACT S19), and if the value does not meet the collection setting condition (NO in ACT S19), it is necessary to take the following actions. For example, a notification section (not shown) provided with a mail creation and sending section sends a mail to the person in charge of collection who has been registered as a mail recipient in advance to urge the person to collect the media, that is, instructing to take an action (ACT S21). If the instruction is completed, the operation of the composite printer apparatus 1 is ended (ACT S22). In addition, if the operation of the composite printer apparatus 1 is ended, all the operations of the automatic teller machine incorporated with the composite printer apparatus 1 may be ended.

Figure 7:
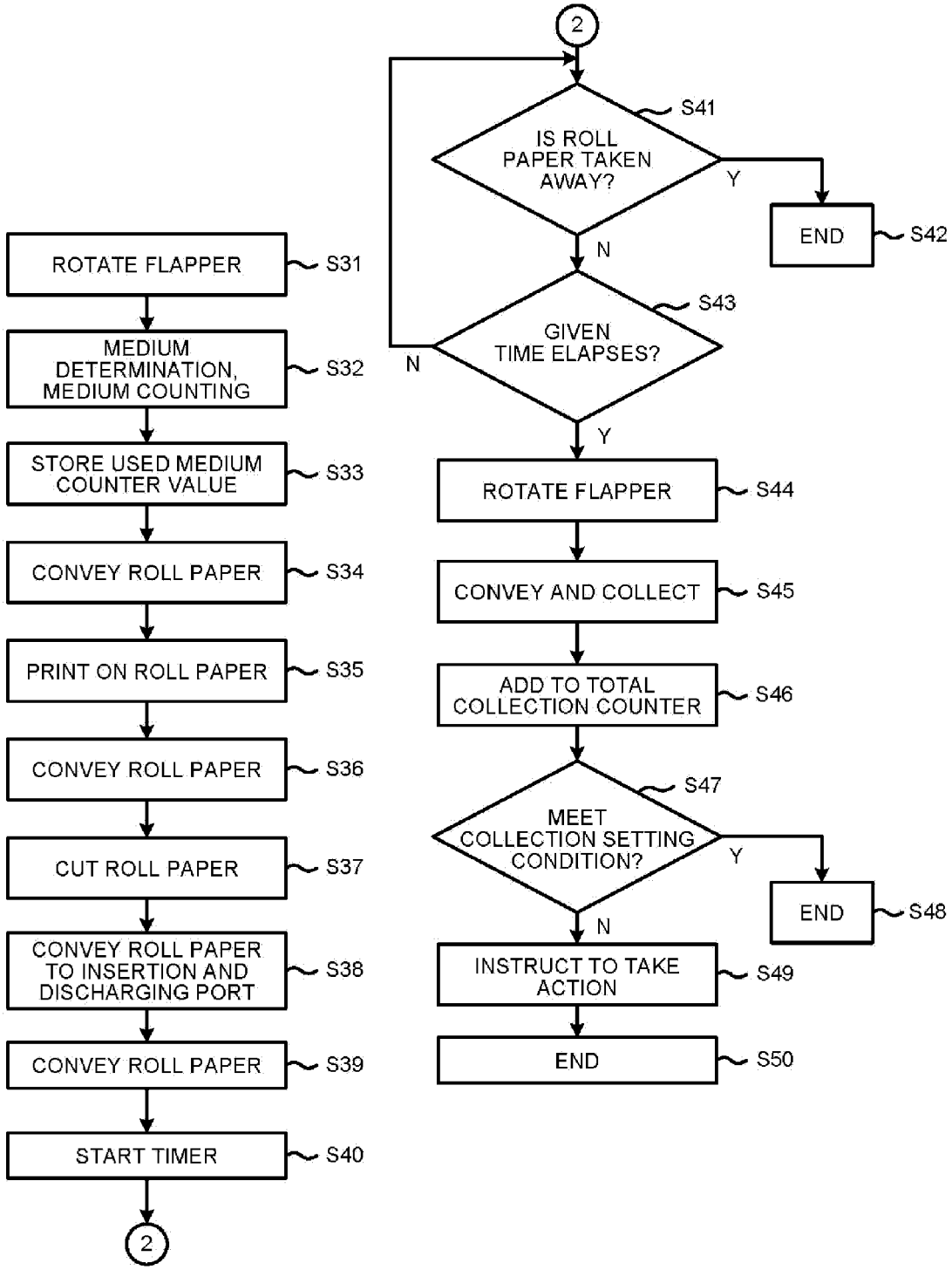
FIG. 7 is a flowchart illustrating a medium count method in a used medium collection when using a business form according to the present embodiment.

Next, the operations of the composite printer apparatus 1 when outputting the business form C using the thermal print head 24 serving as the second printing section 26 of the composite printer apparatus 1 are described with reference to FIG. 1, FIG. 6 and FIG. 7. In addition, the detailed content of the part the same as the function described with the booklet P is omitted.

When the user carries out transaction in an automatic teller machine and the like, the business form C serving as transaction description is output. If the composite printer apparatus 1 receives printing information serving as a business form from the external server 80 of a financial institution and the like, the control section 50 first rotates the flapper 28 anticlockwise around the flapper rotation shaft 28-1 (ACT S31). In this way, the second paper conveyance path 21 is communicated with the first paper conveyance path 5.

Next, the control section 50 calculates the counter value of the medium of the business form C printed by the composite printer apparatus 1 this time by reference to the table (shown in FIG. 6) stored in the collected medium determination section 90 (ACT S32), and stores the value in the used medium counter 91 (ACT S33). In addition, the length of the business form C is automatically calculated by the control section 50 when the printing information serving as the business form is received from the external server 80 of a financial institution and the like.

Then the composite printer apparatus 1 rotates the feed roller 22 to convey the roll paper 15 in the conveyance direction B to the second printing section 26 through the cooperation with the idle roller 23 (ACT S34), and carries out printing on the roll paper 15 using the thermal print head 24 and the platen roller 25 (ACT S35).

After the printing on the roll paper 15 is completed, the control section 50 rotates the feed roller 22 to convey, through the cooperation with the idle roller 23, the roll paper 15 to a position where the cutting position of the roll paper 15 is consistent with the cutting position (not shown) of the cutter 27 (ACT S36), and then drives the cutter 27 to cut the roll paper 15 (ACT S37). The cut roll paper 15 will be given to the user as the business form C.

Next, the composite printer apparatus 1 rotates the feed roller 22 to convey, through the cooperation with the idle roller 23, the business form C in the conveyance direction B to a position where the business form C is placed on the insertion and discharging table 30 and one part of the business form C protrudes from the front surface 33 to the outside of the composite printer apparatus 1, and then stops the conveyance of the roll paper 15 (ACT S38). While conveying the business form C in the conveyance direction B to the insertion and discharging port 2, the composite printer apparatus 1 rotates, at the same time, the feed roller 22 to convey the cut part of the roll paper 15 in a wound state to a position, which is at the upstream side of the second printing section 26 in the conveyance direction B, through the cooperation with the idle roller 23 (ACT S39). The roll paper 15 is conveyed until the front end of the roll paper 15 is conveyed to a position, which is at the upstream side of the second printing section 26 in the conveyance direction B, in preparation for the issuing of a next business form C, so as to shorten the time taken to issue the next business form.

The transmission-type collection sensor 31 is arranged at the insertion and discharging port 2, and if the conveyance of the business form C is stopped at a position where one part of the business form C protrudes from the front surface 33 to the outside of the composite printer apparatus 1, the collection sensor 31 detects that the business form C exists at the position, and the timer 52 starts the timer to start measuring time (ACT S40).

Next, the control section 50 confirms, at a given time interval, whether or not the business form C is taken away by the user (ACT S41), and if it is confirmed that the business form C is taken away by the user (YES in ACT S41), the operation of the user is ended (ACT S42).

If it is determined that the business form C is not taken away by the user (NO in ACT S41), the control section 50 confirms the time of the time measurement, and confirms whether or not the time exceeds the given time (ACT S43).

If the given time does not elapse (NO in ACT S43), it is confirmed again whether or not the business form C is taken away (ACT S41), and if the given time elapses (YES in ACT S43), the control section 50 first rotates the flapper (ACT S44). Next, the control section 50 collects the business form C in the collection box 14 (ACT S45).

Next, the control section 50 adds the counter value of the media used this time stored in the used medium counter 91 to the total collection counter 92 (ACT S46).

Then the control section 50 confirms whether or not the value of the total collection counter 92 meets the collection setting condition (ACT S47), and if the value meets the collection setting condition (YES in ACT S47), the operation of the user is ended (ACT S48). If the value does not meet the collection setting condition (NO in ACT S47), a next instruction is given to urge the user to take an action (ACT S49). If the instruction is completed, the operation of the user is ended (ACT S50).

As stated above, in a case where the user forgets to take a medium such as the booklet P or the business form C, it can be prevented that the medium is taken away by other person. The remaining allowed collection quantity of the collection box 14 is determined according to the total value in the collection box 14 of the used medium counter 91 serving as a condition value of the used medium which takes the different effects of the category of the used medium and the length of the paper on the allowed collection quantity of the collection box 14 into consideration. In this way, the correct effect of each medium category on the allowed collection quantity of the collection box 14 can be known, and it is prevented that the collection box 14 is determined to be full and incapable of collecting one more medium though there is enough space in the collection box 14, and that the collection box 14 is determined to be capable of collecting more media though the collection box 14 is full in fact, and cannot collect one more medium.

A Second Embodiment

Hereinafter, the printer apparatus according to the second embodiment is described in detail with reference to FIG. 8 and FIG. 9. In addition, the detailed description of the constitutions the same as those described in the first embodiment is omitted.

In the first embodiment, the used medium counter value in the used medium is changed according to the length of the booklet P and the business form C, however, in the second embodiment, the used medium counter value is also changed according to the paper thickness of the business form C in addition to the length of the business form C.

Figures 8, 9:
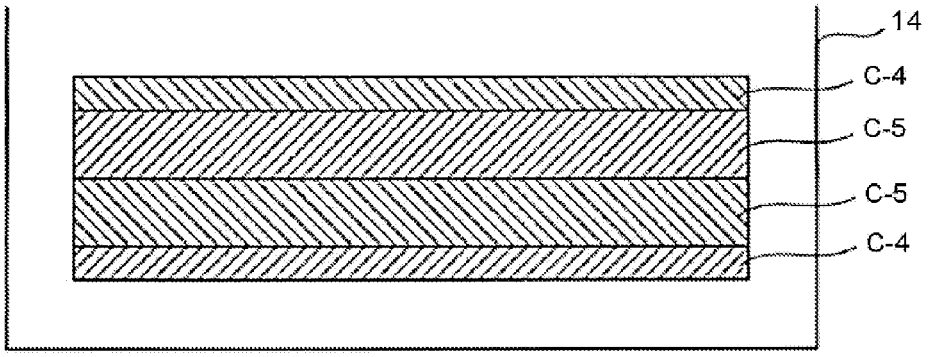
FIG. 8 is an illustration diagram illustrating the effect of the thickness of the business form on the capacity of the collection box according to a second embodiment.
FIG. 9 is a data table illustrating a counter value of each booklet and business form according to the second embodiment.

The effect of the paper thickness of the business form C on the allowed collection quantity of the collection box 14 is illustrated in FIG. 8.

For the business forms having the same length, compared with one piece of collected business form C-4 with thin paper thickness, one piece of collected business form C-5 with thick paper thickness has a larger effect on the allowed collection quantity. With this taken into consideration, as shown by one example in FIG. 9, the used medium counter value is changed according to the thickness of the business form in the table stored in the collected medium determination section 90. In addition, it is recorded in the example shown in FIG. 9 that the paper thickness t2 is twice as thick as the paper thickness t1.

As to the setting of the paper thickness of the business form C, a method of inputting, when the roll paper is loaded in the composite printer apparatus 1, the paper thickness through an input button (not shown) arranged on the display section 32, or a method of selecting the thickness of the used paper from a plurality of paper thickness candidates displayed on the display section 32, or a method of inputting the model number of the roll paper 15 and recognizing the paper thickness using the composite printer apparatus 1, and the like may be used to set the paper thickness. With the paper thickness taken into consideration as stated above, a more correct effect of each medium category on the allowed collection quantity of the collection box 14 can be known, and it can be prevented that the collection box 14 is determined to be full and incapable of collecting one more medium though there is enough space in the collection box 14, and that the collection box 14 is determined to be capable of collecting more media though the collection box 14 is full in fact, and cannot collect one more medium.

A Third Embodiment

Hereinafter, the printer apparatus according to the third embodiment is described in detail with reference to FIG. 10 and FIG. 11. In addition, the detailed description of the constitutions the same as those described in the first and the second embodiments is omitted.

In the first and the second embodiments, in a case where the used medium is the booklet P, the used medium counter values are the same no matter which page is opened. However, in the third embodiment, the used medium counter value is also changed depending on the opened page.

Figure 10:
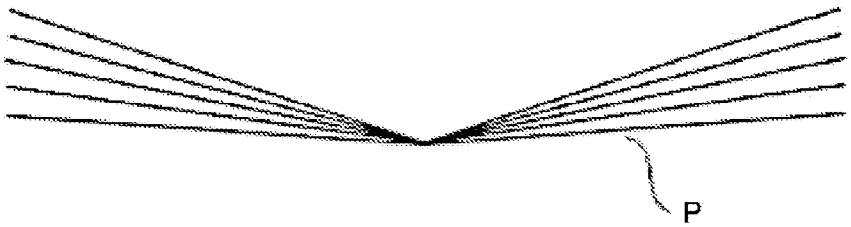
FIG. 10 is an illustration diagram illustrating a state in which the booklet is opened and the number of sheets at the left and the right side are the same according to a third embodiment.
Figure 11:
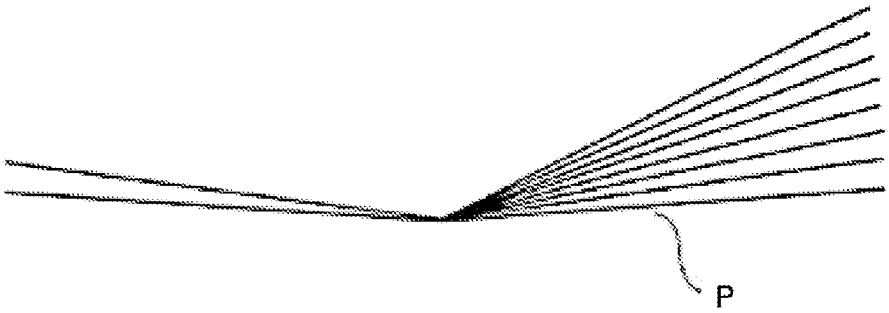
FIG. 11 is an illustration diagram illustrating a state in which the booklet is opened and the number of sheets at the left and the right side are different according to the third embodiment.

The effect of the opened page of the booklet P on the allowed collection quantity of the collection box 14 is illustrated in FIG. 10 and FIG. 11.

For the same booklet P, the effects on the allowed collection quantity are different depending on the opened page. An example is described in which the booklet P used this time is a booklet formed by stapling five pieces of paper at the center thereof.

FIG. 10 illustrates a case where the booklet P is opened at the very middle page, and FIG. 11 illustrates a state in which one side of the saddle has two pieces and the other side has eight pieces of paper. If the booklet P is collected in this state, in the case of FIG. 10, both sides of the saddle has five pieces of paper, thus, the effect on the allowed collection quantity of the collection box 14 is five times compared to a case of one piece of paper. However, in the case of FIG. 11, one side of the saddle has two pieces and the other side has eight pieces of paper. If the booklet is collected in this state, the thicker side has larger effect on the allowed collection quantity, thus, the effect on the allowed collection quantity is eight times compared to a case of one piece of paper. In this way, even for the same booklet P, it can be known which page is opened when the booklet P is collected, and the correct effect of each medium category on the allowed collection quantity of the collection box 14 can be known by changing the used medium counter value according to the number of sheets at the thicker side of the opened page, and therefore, it can be prevented that the collection box 14 is determined to be full and incapable of collecting one more medium though there is enough space in the collection box 14, and that the collection box 14 is determined to be capable of collecting more media though the collection box 14 is full in fact, and cannot collect one more medium.

In addition, which page of the current booklet P is opened is known through a used page determination section which is used to determine the used page of the booklet. When carrying out printing on the booklet P, as the external server 80 can know which page is currently opened, thus, it is also applicable that the page information of the booklet P is provided for the composite printer apparatus 1 by the used page determination section (not shown) arranged in the external server 80. Further, the currently opened page may also be known through the used page determination section (not shown) arranged in the ROM 53 using the page information acquired by the PLF section 10.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus, comprising:

an insertion and discharging port;

a first conveyance path configured to convey a first printing medium inserted from the insertion and discharging port towards a given printing position in a downstream direction, and convey the first printing medium in a direction opposite to the downstream direction and discharge the first printing medium from the insertion and discharging port;

a first printing section configured to carry out printing on the first printing medium conveyed to the printing position;

a second printing section configured, viewed from the insertion and discharging port, at the downstream side of the first printing section and configured to have a printing method different from that of the first printing section;

a second conveyance path configured to merge with the first conveyance path at the downstream side of the first printing section of the first conveyance path so as to discharge a second printing medium printed by the second printing section through the first conveyance path from the insertion and discharging port;

a collection section configured at the downstream side of a mergence section of the first conveyance path and the second conveyance path;

a collected medium determination section configured to determine the medium category of the first printing medium and the second printing medium collected in the collection section and grant a collected medium value for each medium;

a total collection calculation section configured to add up the collected medium values of the media collected in the collection section; and a notification section configured to notify an instruction of removing the collected media from the collection section depending on a result of a comparison of an collection allowable value calculated according to the allowed collection quantity of the collection section and the value of the total collection calculation section.

2. The printer apparatus according to claim 1, wherein the medium condition of the second printing medium is the length of the medium.

3. The printer apparatus according to claim 1, wherein the medium condition of the second printing medium is the thickness of the medium.

4. The printer apparatus according to claim 1, further comprising:

a used page determination section configured to determine the used page of a booklet; wherein the first printing medium is a booklet having a plurality of pages on which printing can be carried out, and the medium determination section grants the collected medium value according to the information of the used page determination section.

* * * * *